US006619201B1

(12) United States Patent
Becker et al.

(10) Patent No.: US 6,619,201 B1
(45) Date of Patent: Sep. 16, 2003

(54) ASSEMBLY INCLUDING A DEVICE FOR HOLDING A SHEET ON A CYLINDER PARTICIPATING IN A REVERSAL OF THE SHEET IN A SHEET-PROCESSING MACHINE

(75) Inventors: Willi Becker, Bammental (DE); Daniel Conzelmann, Dielheim (DE); Andreas Fricke, Eberbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/577,785

(22) Filed: May 24, 2000

(30) Foreign Application Priority Data

May 27, 1999 (DE) ..... 199 24 191

(51) Int. Cl.[7] ..... B41F 5/02
(52) U.S. Cl. ..... 101/230; 101/409; 271/186
(58) Field of Search ..... 101/183, 230, 101/177, 184, 231, 409; 271/184, 186, 902

(56) References Cited

U.S. PATENT DOCUMENTS 4,186,662 A * 2/1980 Borneman ..... 101/218
4,869,166 A 9/1989 Mathes
4,930,414 A * 6/1990 Wirz ..... 101/183
5,063,843 A * 11/1991 Becker ..... 101/183
5,413,040 A * 5/1995 Sugiyama et al. ..... 101/230
5,454,312 A * 10/1995 Helmstaedter et al. ..... 101/230
5,609,103 A * 3/1997 Stephan et al. ..... 101/230
6,089,157 A * 7/2000 Becker et al. ..... 101/230

FOREIGN PATENT DOCUMENTS

| | | |
|---|---|---|
| DE | 258 400 A1 | 7/1988 |
| DE | 42 10 432 A1 | 10/1993 |
| DE | 42 11 381 A1 | 10/1993 |
| DE | 195 14 252 C1 | 8/1996 |
| DE | 195 47 580 A1 | 8/1997 |
| EP | 0 306 684 A2 | 3/1989 |
| EP | 0 585 897 B1 | 3/1994 |
| GB | 2 299 803 B | 10/1996 |

* cited by examiner

*Primary Examiner*—Ren Yan
(74) *Attorney, Agent, or Firm*—Laurence A. Greenberg; Werner H. Stemer; Gregory L. Mayback

(57) ABSTRACT

An assembly including a device for holding a sheet on a cylinder participating in a reversal of the sheet, includes a region wherein the holding device is effective for holding a sheet, the effective region for the holding device being located downline, as viewed in a sheet transport direction, from an upline effective region wherein the sheet is gripped by a lifting device.

11 Claims, 3 Drawing Sheets

ASSEMBLY INCLUDING A DEVICE FOR HOLDING A SHEET ON A CYLINDER PARTICIPATING IN A REVERSAL OF THE SHEET IN A SHEET-PROCESSING MACHINE

BACKGROUND OF THE INVENTION

Field of the Invention

The invention relates to an assembly including a device for holding a sheet on a cylinder participating in a reversal of the sheet in a sheet-processing machine.

The published European Patent Document EP 0 306 684 A2 discloses a so-called single-drum sheet-reversing or turning device in a sheet-fed rotary printing machine, wherein a sheet printed on a first side thereof is picked up directly from an upline impression cylinder by a sheet reversing or turning cylinder and, after having been reversed or turned, is transferred to a succeeding impression cylinder.

A blowing or blast device arranged directly upline from the pick-up or take-over location between the upline impression cylinder and the sheet reversing cylinder presses the sheet by blown or blast air onto the surface of the impression cylinder in a region upline from the pick-up location, in order to improve the in-register action of picking up the sheet from the impression cylinder.

By arranging the blowing device upline from the location at which the sheet is transferred from the upline impression cylinder to the sheet reversing or turning cylinder, as viewed in the sheet transport direction, the holding force on the end of the sheet becomes ineffective before the sheet end is picked up by the gripper device of the sheet reversing or turning cylinder.

Especially at machine speeds below the minimum production printing speed, such as during inching or crawling, and braking the machine during an emergency stop and subsequent re-starting, the end of the sheet is not adequately held, so that faults in the turning or reversing register may occur. In the worst case, a sheet can even be lost as it is being turned, i.e., the sheets which are released fall into the machine.

SUMMARY OF THE INVENTION

It is accordingly an object of the invention to provide a device for holding a sheet on a cylinder participating in a reversal of the sheet in a sheet processing machine, wherein the sheet is held on the cylinder in all possible operating conditions, so that a problem-free paper run is possible.

With the foregoing and other objects in view, there is provided, in accordance with the invention, an assembly including a device for holding a sheet on a cylinder participating in a reversal of the sheet, comprising a region wherein the holding device is effective for holding a sheet, the effective region for the holding device being located downline, as viewed in a sheet transport direction, from an upline effective region wherein the sheet is gripped by a lifting device.

In accordance with another feature of the invention, the holding device is constructed as an activatable holding roller.

In accordance with a first alternative feature of the invention, the holding device is constructed as a blowing device.

In accordance with a second alternative feature of the invention, the holding device is constructed as a guiding device.

In accordance with a third alternative feature of the invention, the holding device is a combination of a holding roller and a blowing device.

In accordance with a fourth alternative feature of the invention, the holding device is a combination of a holding roller and a guiding device.

In accordance with a fifth alternative feature of the invention, the holding device is a combination of a blowing device and a guiding device.

In accordance with a sixth alternative feature of the invention, the holding device is a combination of a holding roller, a blowing device and a guiding device.

In accordance with a further feature of the invention, the assembly includes a plurality of blowing devices provided for holding the sheet on the cylinder.

In accordance with a concomitant feature of the invention, the cylinder is an impression cylinder of a sheet-fed rotary printing machine, and the lifting device is mounted on a reversing or turning drum so as to be extendable.

An advantage of the invention is that the sheets to be turned or reversed are reliably held even at low machine speeds and even downline of the transfer location.

The construction of the holding device as a pressure roller is particularly advantageous. A pivotable mounting permits the pressure roller to be brought into and out of contact from an out-of-contact or disengaged position for production printing into an in-contact or engaged position on the cylinder in a speed range below the minimum production printing speed.

The pressure roller can preferably be employed for all thicknesses of paper from thin bible paper up to thick cardboard or pasteboard.

In an alternative configuration, in particular for processing thin paper thicknesses, the holding device is constructed as a blowing device, which directs a blown-air or blast-air holding jet onto the sheet, so that the latter is pressed against the upline cylinder. In this regard, a blown or blast jet device which is oriented counter to the travel or transport direction of the sheet is particularly beneficial. This measure avoids any necessity for blowing underneath the sheet at the trailing edge thereof.

In a further alternative configuration, in particular for processing thick paper thicknesses, a guiding device is provided which is constructed as a guide bracket or guide plate and has a tip extending into a region downline from the take-over location. A pivotable mounting permits the guide bracket or the guide plate to be adjusted with respect to the impression cylinder so that spacing between the guiding device and the impression cylinder narrows in the sheet transport direction. Due to the inherent stress in thicker cardboard or pasteboard, it has the property of resting against the guiding device. A result thereof, in particular in the region of the tip of the guiding device, is that the cardboard or pasteboard sheet is held firmly on the cylinder in the transfer position even when the machine is operating slowly or is at a standstill. Due to the adjustability of the guiding device by a setting or adjusting device that is provided, the spaced distance of the guiding device from the cylinder can be set as a function of the thickness of the printing material (cardboard or pasteboard) to be processed. The trailing edge of the sheet can thereby be guided in a controlled manner by the guiding device.

While the guiding device for thick-paper thicknesses and the blowing device for thin-paper thicknesses remain continuously in the position thereof on the cylinder, both during production printing and at crawl, provision is made for the pressure roller to be connected in and activated, respectively, only at a predetermined machine speed.

A combination of pressure roller and guide bracket, or pressure roller and blowing device, or guide bracket and blowing device improves the action or effect of the device according to the invention.

The combination of a pressure roller, a blowing device and a guide bracket constitutes the optimum in functionally technical terms.

In a device for turning or reversing a sheet in a sheet-fed rotary printing machine, provision is made to transfer a sheet directly, after it has been turned or reversed, from an upline impression cylinder to a downline impression cylinder by a turning or reversing device.

In order that the sheet be held properly on the cylinder during the turning or reversing operation, in particular at a slow speed lying below a minimum production printing speed, one or more holding devices are provided, which are arranged in an effective region which, as viewed in the sheet transport direction, is located downline of an effective region for the lifting device of the turning or reversing drum.

Other features which are considered as characteristic for the invention are set forth in the appended claims.

Although the invention is illustrated and described herein as embodied in a device for holding a sheet on a cylinder participating in a reversal of the sheet in a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
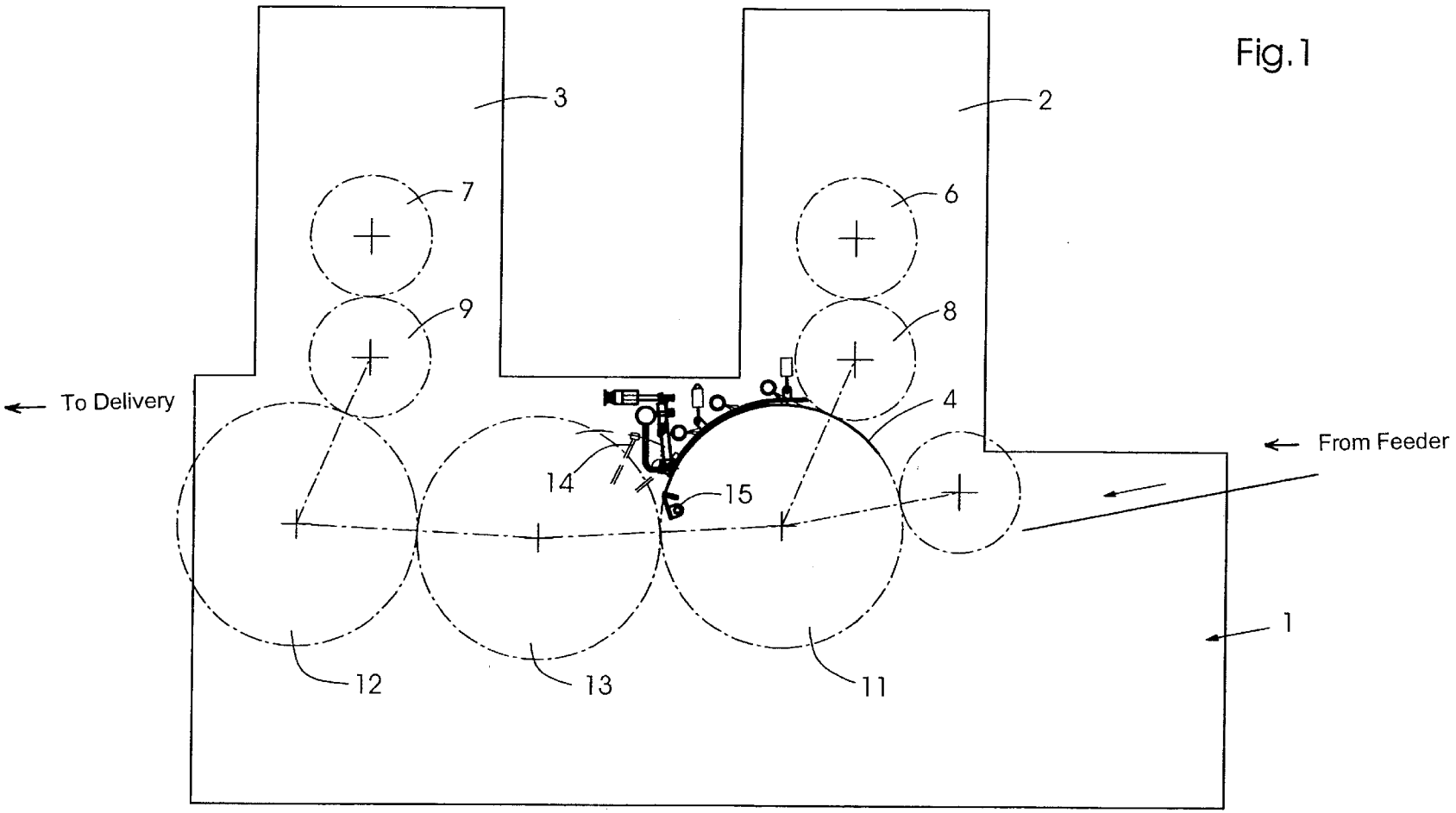
FIG. 1 is a diagrammatic side elevational view of a sheet-fed rotary printing machine having a turning or reversing device incorporating the holding device according to the invention.

Referring now to the drawings and, first, particularly to FIG. 1 thereof, there is shown therein a sheet-processing printing machine 1, for example a rotary printing machine, having a feeder, at least one printing unit 2, 3 and a delivery. Sheets 4 are taken from a sheet pile and fed to the printing units 2 and 3 individually or in an overlapping or imbricated formation over a feed table. As is generally known, each of the printing units 2 and 3 includes a plate cylinder 6, 7, respectively. Each of the plate cylinders 6 and 7 has a device for affixing flexible printing plates thereto. Each plate cylinder 6, 7 cooperates with a respective blanket cylinder 8, 9, and the latter cooperates with a respective impression cylinder 11, 12. Arranged between the impression cylinders 11 and 12, which are preferably of so-called double-size construction, i.e., twice the diameter of the respective plate cylinders 6 and 7 and blanket cylinders 8 and 9, is a reversing or turning drum 13 that picks up a sheet 4 by the trailing edge thereof, the sheet 4 being held on the upline impression cylinder 11 by transport grippers 15 provided on the latter, and transfers the sheet 4 in turned or reversed condition to the downline impression cylinder 12.

For this purpose, a lifting device 14 is provided on the reversing or turning drum 13 and is disposed so that it is extendable beyond or out of the periphery of the turning drum 13 and, after the sheet 4 has been lifted off the impression cylinder 11, transfers it to holding elements formed as non-illustrated gripper devices, which are likewise extendable out of the periphery of the turning drum 13.

The lifting device 14 is preferably subjectible to an application of suction air. In order to maintain in a defined position on the impression cylinder 11 the sheet 4 that is to be reversed or turned, more particularly the trailing edge thereof, devices which hold the sheet 4 on the impression cylinder 11 are provided in the transport region between the blanket cylinder 8 and the turning or reversing drum 13, so that the sheet 4 can be gripped at the trailing edge thereof with positioning accuracy by the lifting device 14.

Figure 2:
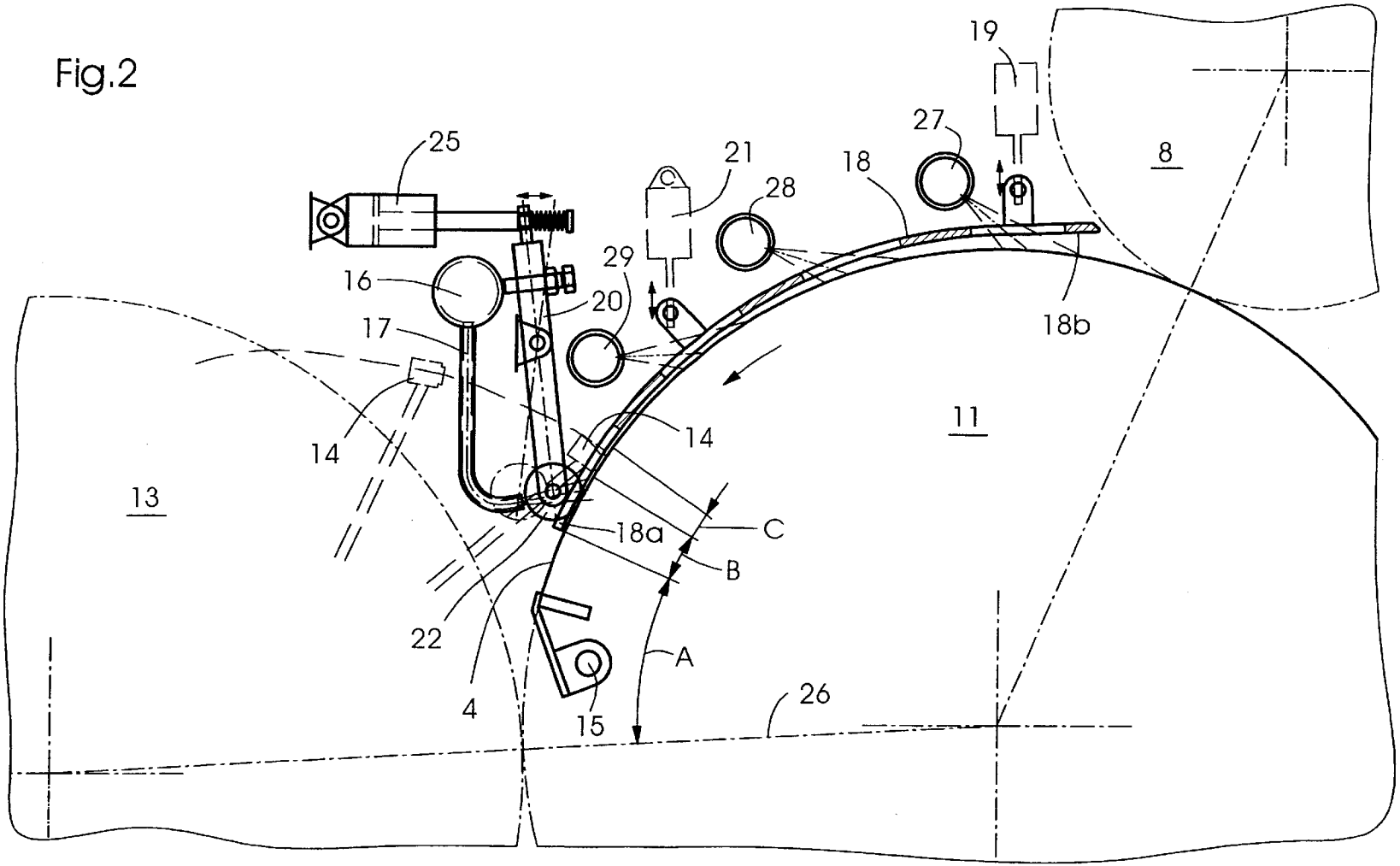
FIG. 2 is an enlarged fragmentary view of FIG. 1 showing the turning or reversing device with a sheet holding roller brought into contact with an upline cylinder in accordance with the invention.
Figure 3:
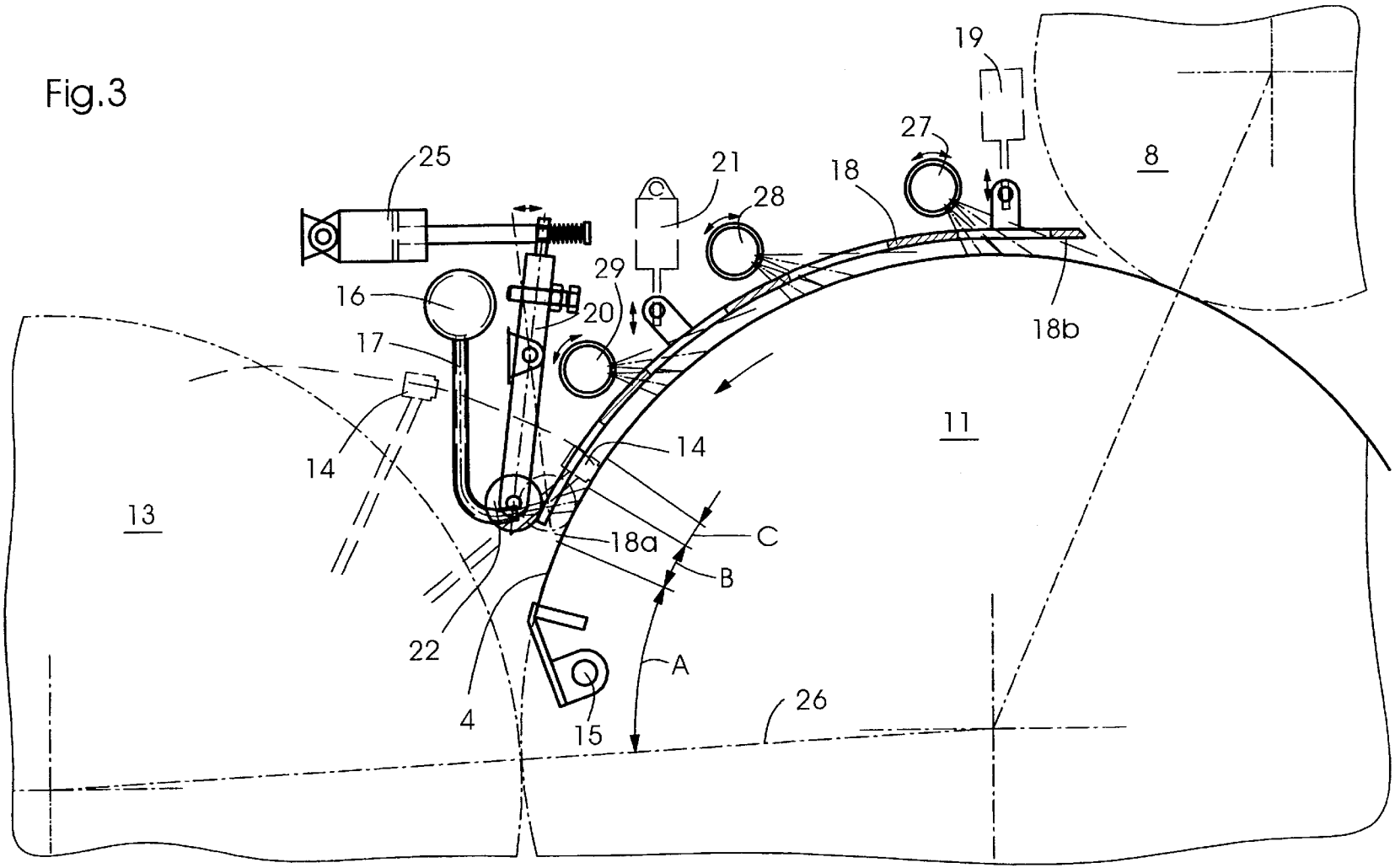
FIG. 3 is another view of FIG. 2, showing the turning or reversing device in a different operating phase wherein the holding roller has been brought out of contact with the upline cylinder.

As is shown in greater detail in FIG. 2, for processing thin paper, a blowing or blast device 16 with a blast-air jet directed onto the impression cylinder 11 is provided. The blowing device 16 has at least one blast tube 17, and preferably a plurality of blast tubes arranged axially at a distance from one another over the length of the impression cylinder 11.

For processing thick paper (cardboard or pasteboard), a guiding device 18 is disposed at a spaced distance from the periphery of the impression cylinder 11. The spacing of the guiding device 18 from the impression cylinder 11 is adjustable by two independently controllable adjusting or setting devices 19 and 21. For accurate positioning of the trailing edge of the board or thick paper, it may be expedient to set the guiding device 18 closer to the impression cylinder 11 at the rear or trailing end 18*a* of the guiding device 18, as viewed in the sheet transport direction, than at the front or leading end 18*b* of the guiding device 18. In the axial direction of the impression cylinder 11, the guiding device 18 is formed with a number of apertures, through which the blowing device 16 can blow air, or through which the lifting device 14 can extend. At least one PivotTable arranged holding or retaining roller 22 is disposed in an effective range or region of the blowing device 16 and of the end 18*a* of the guiding device 18. The holding roller 22 or, if necessary or desirable, a plurality of holding rollers 22 arranged axially distributed likewise extend through apertures formed in the guiding device 18, so that they can be brought into contact with the impression cylinder 11 in order to press onto or against the impression cylinder 11 the sheets 4 which are to be transported. The holding roller 22 is freely rotatably mounted so that it is pivotable at the end of a double-arm lever 20. An adjusting or setting element in the form of an operating cylinder 25, provided for controlling the holding roller 22, acts at an end of the lever 20 facing away from the holding roller 22.

The effective range B of the holding roller 22, the end 18*a* of the guiding device 18 and the blast tube 17, as viewed in the sheet transport direction, is located downline of the range or region C wherein the lifting device 14 is placed on the sheet 4. This measure ensures that, at low speeds which lie below the minimum production-printing speed, the sheet 4 is held on the cylinder 11 in a defined position and, for example because of the inherent weight thereof, cannot slip downwardly in a direction towards a center line 26 between the impression cylinder 11 and the reversing or turning drum 13.

Arranged above the impression cylinder 11, over an area covered by the guiding device 18, are blowing or blast devices 27, 28 and 29, which blow air through apertures formed in the guiding device 18 towards the surface of the impression cylinder 11, preferably counter to the travel direction of the sheet 4 represented by the curved arrow associated therewith, in order to press the latter onto the impression cylinder 11, in particular during production printing.

A sheet 4 to be turned that is transported by the gripper device 15 of the impression cylinder 11, is guided by the holding roller 22 brought into contact with the impression cylinder 11, and held against slipping off, in particular during inching or crawling operations.

The holding roller 22 can be employed for all types of paper from thin paper (e.g. bible-printing paper) to thick paper (e.g. cardboard or pasteboard).

If thin paper is being processed, it may even be enough just to employ the blowing device 16. If thick paper is being processed, it may be enough to use the guiding device 18 because, due to the stiffness of the thick paper or board, it has a tendency to move away from the periphery of the impression cylinder 11 and to rest against the guiding device 18, whereat it is braked, due to the inherent stress thereof, so that it stays there because of the overall stiffness thereof.

During the turning or reversing operation, the sheet is guided at the leading edge thereof on the impression cylinder 11, by the gripper device 15, until the end of the sheet passes into the effective region or range C of the lifting device 14. Because the holding devices, namely the holding roller 22, the blowing device 17 and the guiding-device end 18*a*, are disposed within an effective region or range B provided downline of the effective region or range C, as viewed in the sheet transport direction, the sheets 4 are held firmly on the impression cylinder 11 until the lifting device 14 has gripped the sheets 4. The lifting device 14 then holds the sheet 4 on the impression cylinder 11 until the trailing edge of the sheet 4 and the lifting device 14 have passed through the effective region or range B. Then, within a following region or range A, the trailing edge of the sheet 4 is lifted from the impression cylinder 11 and transferred to the turning or reversing drum 13.

In order to prolong the time required for the lifting device 14, to which suction air is preferably applied and which is disposed so that it is extendable beyond or out of the periphery of the turning or reversing drum 13, to attract the sheet to be turned or reversed by suction, for example at relatively high printing speeds, the adjusting or setting element 25 and a suitable arrangement of the blowing device 16 relative to the impression cylinder 11 can be utilized for performing a pivoting action, in order to adjust the location at which the blast-air jet impinges upon the impression cylinder 11 in the circumferential direction within the effective region or range B or within or upline of the effective region or range C. This can be performed automatically or manually, for example, based upon the printing speed or the thickness of the printing material.

We claim:

1. An assembly for reversing a sheet after being printed on a first side in a printing unit having a blanket cylinder, the assembly comprising:

a cylinder having an upline effective region and a downline effective region with respect to a sheet transportation direction;

a reversing drum disposed downstream with respect to said cylinder in the sheet transportation direction, defining a nip between said cylinder and said reversing drum and defining a transport region between the blanket cylinder and said reversing drum;

a lifting device provided on said revering drum for gripping and lifting the sheet from said cylinder in the upline effective region in the sheet transportation direction in front of the nip; and a holding device for holding the sheet in the downline effective region, said holding device being fixedly disposed in said transport region in the sheet transportation direction and behind said lifting device.

2. The assembly according to claim 1, wherein the holding device is constructed as an activatable holding roller.

3. The assembly according to claim 1, wherein the holding device is constructed as a blowing device.

4. The assembly according to claim 1, wherein the holding device is constructed as a guiding device.

5. The assembly according to claim 1, wherein the holding device is a combination of a holding roller and a blowing device.

6. The assembly according to claim 1, wherein the holding device is a combination of a holding roller and a guiding device.

7. The assembly according to claim 1, wherein the holding device is a combination of a blowing device and a guiding device.

8. The assembly according to claim 1, wherein the holding device is a combination of a holding roller, a blowing device and a guiding device.

9. The assembly according to claim 1, including a plurality of blowing devices provided for holding the sheet on the cylinder.

10. The assembly according to claim 1, wherein said cylinder is an impression cylinder of a sheet-fed rotary printing machine, and said lifting device is mounted on said reversing drum so as to be extendable.

11. In a sheet-processing printing machine having a printing unit with a blanket cylinder, an assembly for reversing a sheet comprising:

a cylinder having an upline effective region and a downline effective region with respect to a sheet transportation direction;

a reversing drum disposed downstream with respect to said cylinder in the sheet transportation direction, defining a nip between said cylinder and said reversing drum and defining a transport region between the blanket cylinder and said reversing drum;

a lifting device provided on said reversing drum for gripping and lifting the sheet from said cylinder in the upline effective region in the sheet transportation direction in front of the nip; and a holding device for holding the sheet in the downline effective region, said holding device being fixedly disposed in said transport region in the sheet transportation direction and behind said lifting device.

* * * * *